US010478985B2

(12) United States Patent
Perini

(10) Patent No.: US 10,478,985 B2
(45) Date of Patent: Nov. 19, 2019

(54) MACHINE FOR CUTTING CARDBOARD TUBES

(71) Applicant: FUTURA S.P.A., Capannori (LU), Fraz. Guamo (IT)

(72) Inventor: Fabio Perini, Viareggio (IT)

(73) Assignee: FUTURA S.P.A., Capannori (LU), Fraz. Guamo (IT)

( * ) Notice: Subject to any disclaimer, the term of this patent is extended or adjusted under 35 U.S.C. 154(b) by 275 days.

(21) Appl. No.: 15/304,264

(22) PCT Filed: Jan. 28, 2015

(86) PCT No.: PCT/IT2015/000014

§ 371 (c)(1),
(2) Date: Oct. 14, 2016

(87) PCT Pub. No.: WO2015/159311

PCT Pub. Date: Oct. 22, 2015

(65) Prior Publication Data

US 2017/0043494 A1 Feb. 16, 2017

(30) Foreign Application Priority Data

Apr. 17, 2014 (IT) ..... FI2014A0088

(51) Int. Cl.
*B26D 3/16* (2006.01)
*B26D 1/60* (2006.01)
(Continued)

(52) U.S. Cl.
CPC ..... *B26D 3/16* (2013.01); *B26D 1/60* (2013.01); *B26D 5/22* (2013.01); *B26D 7/0683* (2013.01)

(58) Field of Classification Search
CPC ... B26D 3/16; B26D 1/60; B26D 5/22; B26D 7/0683
See application file for complete search history.

(56) References Cited

U.S. PATENT DOCUMENTS 4,258,613 A * 3/1981 Fegley ..... B26D 1/60 493/22
4,370,140 A * 1/1983 Fegley ..... B26D 1/60 493/289

(Continued)

FOREIGN PATENT DOCUMENTS

WO 95/10399 A1 4/1995
WO 95/10400 A1 4/1995
WO 2009/001210 A1 12/2008

*Primary Examiner* — Omar Flores Sanchez
(74) *Attorney, Agent, or Firm* — McGlew and Tutte, P.C.

(57) ABSTRACT

Machine for cutting cardboard tubes, including a cutting unit (CU) with a carriage (7) on which is mounted a blade (6) and a support element (4, 5, 8) for supporting a cardboard tube (1) intended to be transversely cut by the blade (6). The support element (4,5,8) allows the tube (1) to slide along a predetermined direction (A) parallel to its axis longitudinal (x) and to rotate about the same axis, and the carriage (7) is adapted to move bidirectionally the blade (6) parallel to the longitudinal axis (x) of the tube (1). The support element (4,5,8) has, where the cutting unit (CU) is arranged, apart (5) movable from and towards the blade (6) to maintain the tube (1) spaced from the latter and, respectively, for approaching the tube to the same blade (6) during a cutting phase.

11 Claims, 8 Drawing Sheets

(51) Int. Cl.
*B26D 5/22* (2006.01)
*B26D 7/06* (2006.01)

(56) References Cited

U.S. PATENT DOCUMENTS

| | | | | |
|---|---|---|---|---|
| 5,950,513 | A * | 9/1999 | Bourakovski ..... | B23D 25/04<br>83/318 |
| 2014/0083271 | A1 * | 3/2014 | Lai ..... | B23D 45/20<br>83/310 |

* cited by examiner

MACHINE FOR CUTTING CARDBOARD TUBES

The present invention relates to a machine for cutting cardboard tubes, in particular for manufacturing paper rolls or "logs".

It is known that in the paper converting industry the tube-forming machines are used to produce the cardboard tube (also known as "core") on which the paper is wound to form a roll or "log" that, at a later stage, is divided in a plurality of elements having a given length to obtain toilet paper rolls, kitchen paper rolls etc. The tube is made of cardboard strips that are unwound from corresponding reels and are wound onto a horizontal metal spindle and glued to each other thus forming a self-supporting tubular body. Generally, two or three cardboard strips are used, depending on the thickness of the cardboard core to be manufactured. However, it is possible to manufacture cardboard cores with a single cardboard strip. The cardboard strips are partially superimposed on each other and, by means of a eight-shaped belt wound on two driving rollers, they are rolled around the spindle and pushed forward to obtain the tubular cardboard tube that advances along the same spindle. Said belt is also wound around the spindle so as to engage the incoming cardboard strips and produce the effect described above. A cutting unit is used to cut the tubular cardboard tube to a predetermined length corresponding to the length of the logs to be produced by means of other machines called "rewinders". The conventional cutting units provide concurrent execution of three movements: bi-directional movement of a blade supporting carriage parallel to the tube subjected to cutting, rotary motion of the blade about its own axis, and vertical movement of the blade during the cutting step. This implies drawbacks due to the constructive complexity, the weight and maintenance requirements of such cutting units.

The main purpose of the present invention is to simplify the construction of the cutting units destined to cut cardboard tubes, in particular tubes used for the production of paper rolls or "logs".

This result is achieved, according to the present invention, by providing a machine having the characteristics indicated in claim 1. Other features of the present invention are object of the dependent claims.

Thanks to the present invention, it is possible to provide a machine for cutting cardboard tubes that is simpler, lighter, more reliable, more economical and requires less frequent maintenance.

These and other advantages and features of the present invention will be best understood by anyone skilled in the art thanks to the following description and to the attached drawings, provided by way of example but not to be considered in a limiting sense, in which.

Figure 6:
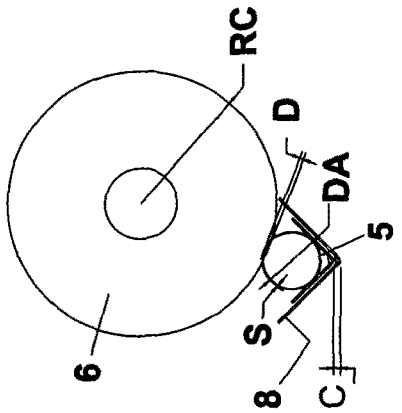
FIGS. 5 and 6 are two schematic front views of the cutting unit, wherein some parts are omitted to better show other parts, in the tube-forming configuration (FIG. 5) and respectively in the cutting configuration (FIG. 6)
Figure 5:
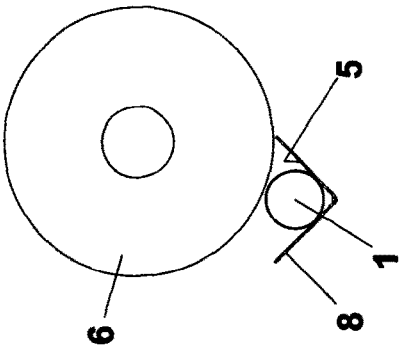
Figure 4:
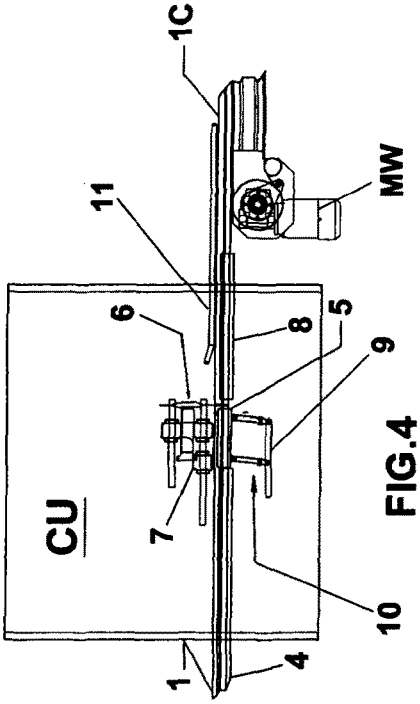
FIG. 4 is similar to FIG. 4 but it shows the cutting unit (CU) in the cutting configuration.
Figure 1:
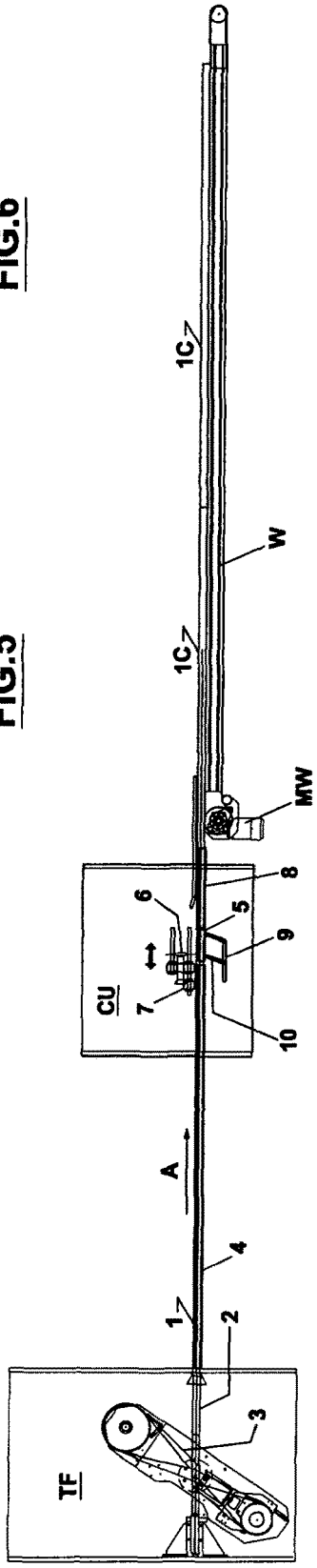
FIG. 1 is a schematic side view of a cutting machine (CU) according to the present invention located downstream of a tube-forming machine (TF) during the production of a tube.
Figure 2:
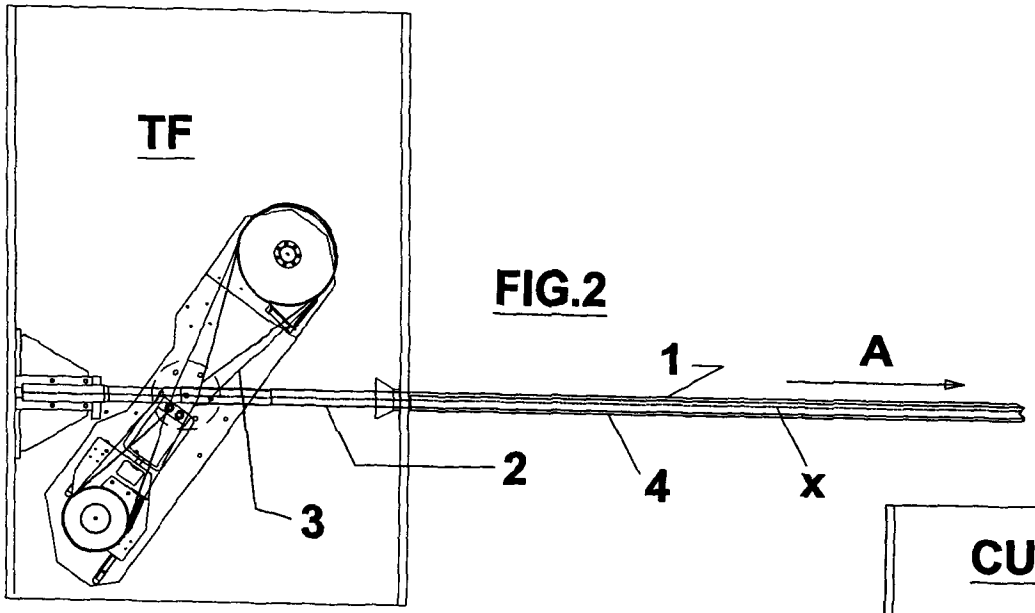
FIG. 2 is an enlarged detail of FIG. 1.
Figure 3:
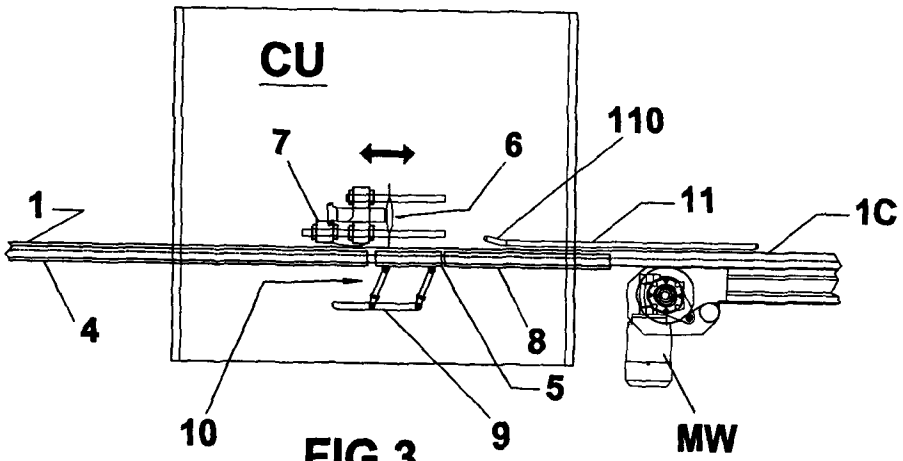
FIG. 3 is another enlarged detail of FIG. 1.

With reference to the accompanying drawings, a cutting machine or cutting unit (CU) in accordance with the present invention is positioned downstream of a tube-forming machine (TF) which produces the tube (1) by means of helical winding of one or more strips of cardboard on a spindle (2) with the aid of a belt winder (3). The operation and the structure of the tube-forming machine (TF) are known to those skilled in the art and, therefore, are not described in greater detail. A tube-forming machine of this type is described, for example, in WO 95/10400 and WO 95/10399.

The tube (1) that gradually forms on the mandrel (2) moves on a fixed horizontal guide (4) having a transverse profile in the shape of "V" with the concavity facing upwards. While advances (arrow "A"), the tube (1) is also subject to rotation about its longitudinal axis (x). Said guide (4) extends up to the cutting unit (CU) where, downstream of the guide (4), is arranged another guide (5) which, as further described in the following, is connected to a device which controls its vertical movement. The second guide (5) is also horizontal and has a transverse profile in the shape of "V" with the concavity facing upwards. Furthermore, the second guide (5) is in correspondence of the cutting unit (CU), that is in a position below a circular blade (6) through which the tube (1) is cut. Said blade (6) is mounted on a carriage (7) which allows to move it parallel to the guides (4) and (5), i.e. parallel to the tube (1) to be cut. Moreover, the blade (6) is oriented orthogonally to the guides (4) and (5). In other words, the cutting plane of the blade (6) is transverse relative to the tube (1).

Downstream of the second guide (5) there is a third guide (8) which, as the first guide (4), is fixed. The third guide (8) is also horizontal, providing an ideal extension of the first guide (4).

Between the first guide (4) and the second (5) there is an empty space. Similarly, there is an empty space between the second guide (5) and third (8).

The said first, second and third guides (4, 5, 8) act as a support for the tube (1).

As previously mentioned, the second guide (5) is associated with a device which controls its vertical movement. Said device, in the example shown in the drawings, comprises a linear actuator (9) connected by two parallel levers (10) to the lower surface of the guide (5). Through the levers (10), the run to the right or to the left of the actuator (9) implies the corresponding lifting or lowering of the guide (5).

It is understood, however, that the vertical movement of the second guide (5) can be obtained in any other way.

When the second guide (5) is lifted, the portion of the tube (1) lying on the same second guide (5) is pushed towards the overlying blade (6) which, by rotating around its own axis, determines its cut. Conversely, when the second guide (5) is lowered, i.e. aligned with the fixed guides (4, 8), there is no contact between the blade (6) and the tube (1) which, therefore, is not cut. The lifting of the guide (5), and consequently of the tube (1) in the area of intervention of the blade (6), is of value "C" such that, said "D" the minimal interference between the tube (1) and the blade (6) required to perform the cut, and said "S" the thickness of the tube (1), it is D>S. It is understood that the value "C" is determined on the basis of the position and radius "RC" of the blade (6) and the thickness and diameter "DA" of the tube (1) to be cut.

Above the third guide (8) may possibly be arranged another guide (11) with a mouth (110) oriented towards the cutting unit (CU).

The inherent flexibility of the tube (1) allows to push up its part lying on the second guide (5) without the need to retain even the parts that lie on the first and third guide.

During said step of cutting the blade (6) advances horizontally and parallel to the tube (1) which in the meantime advances on the guides since the underlying tube-forming machine (TF) is not stopped. This advancement of the blade (6) is allowed by the carriage (7) which is suitably motorized. At the end of the cut, or after a predetermined time, the carriage (7) brings the blade (6) in its starting position.

In this way, the carriage (7) must only support the blade (6) with the associated motor (not visible in the drawings) and needs not to approach the blade (6) to the tube (1) since the second guide (5) pushes the latter towards the blade (6). The guides (4), (5), and (8) form, on the whole, a cradle or a support in which the tube (1) can slide, with a part (in the example, the second guide 5) that can be moved by and towards the blade (6) to obtain the corresponding movement of the tube (1) in order to move it towards the blade (6) during execution of the cut and to keep it spaced from the blade (6) during the tube formation (1). In the accompanying drawings, the reference "W" indicates a belt conveyor driven by a corresponding motor (MW), placed downstream of the cutting unit (CU), to remove the portions (1C) formed by the cutting of the tube (1).

Figure 7:
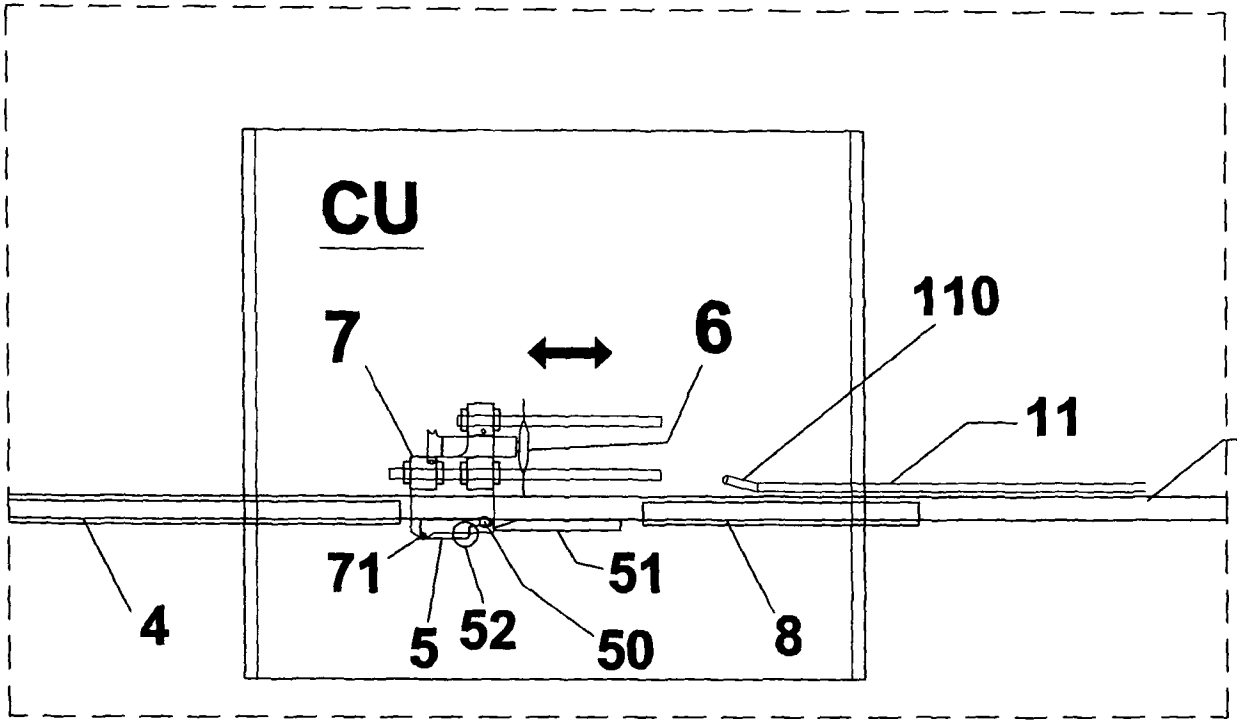
FIGS. 7 and 8 are similar to FIGS. 5 and 6 but they refer to a further embodiment of a cutting unit according to the present invention.
Figure 8:
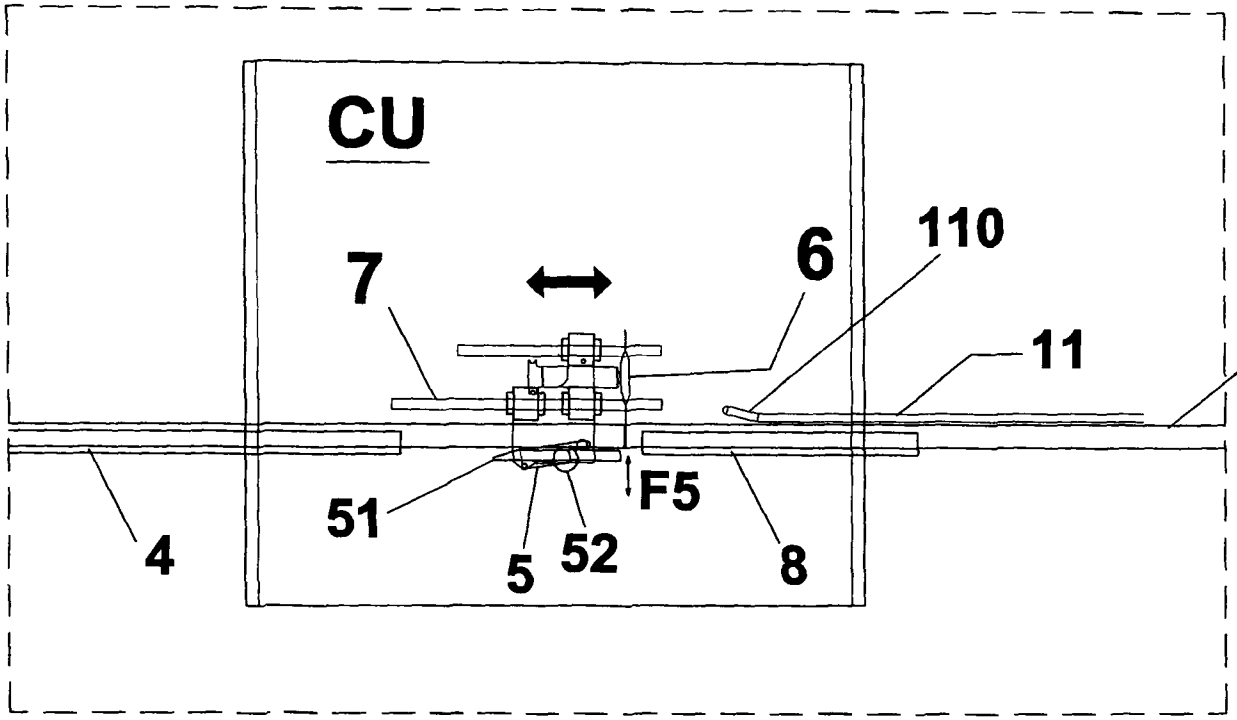

With reference to the example shown in FIG. 7 and FIG. 8, the second guide (5) is secured to the carriage (7), that is hinged at its rear (the side facing the tube-forming machine TF) to a lower appendage (70) of the carriage (7) by a pin (71) with horizontal axis. More particularly, the axis of the pin (71) is orthogonal to the aforementioned direction "A". In this way, the second guide (5), being free to oscillate around the axis of the pin (71), can rotate as further described in the following. In its front part the second guide of the example of FIG. 7 and FIG. 8 is provided with a roller (50) adapted to slide on a cam (51) placed in a fixed position between the fixed guides (4, 8) under the blade (6). Moreover, the second guide of the example of FIG. 7 and FIG. 8 is provided with a wheel (52) in an intermediate position between the pin (71) and the roller (50). When the carriage advances in the direction "A", the roller (50) intercepts the cam (51) and therefore the second guide (5) is raised, rotating around the axis of the pin (71). It follows the lifting of the wheel (52) that, consequently, raises the tube (1) towards the blade (6). When the carriage (7) is brought back, the second guide (5) is also brought into the lowered starting position. The presence of the wheel (52) reduces the friction with the tube (1) that during the cut moves forward and rotates on its longitudinal axis. In FIG. 7 the guide (5) is in the lowered position, whereas in FIG. 8 the same guide (5) is raised. The cam (51) is raised and lowered, as indicated by the arrow "F5", to place the same cam in position of lifting of the second guide (5) and respectively in position of lowering of the latter.

Figure 9:
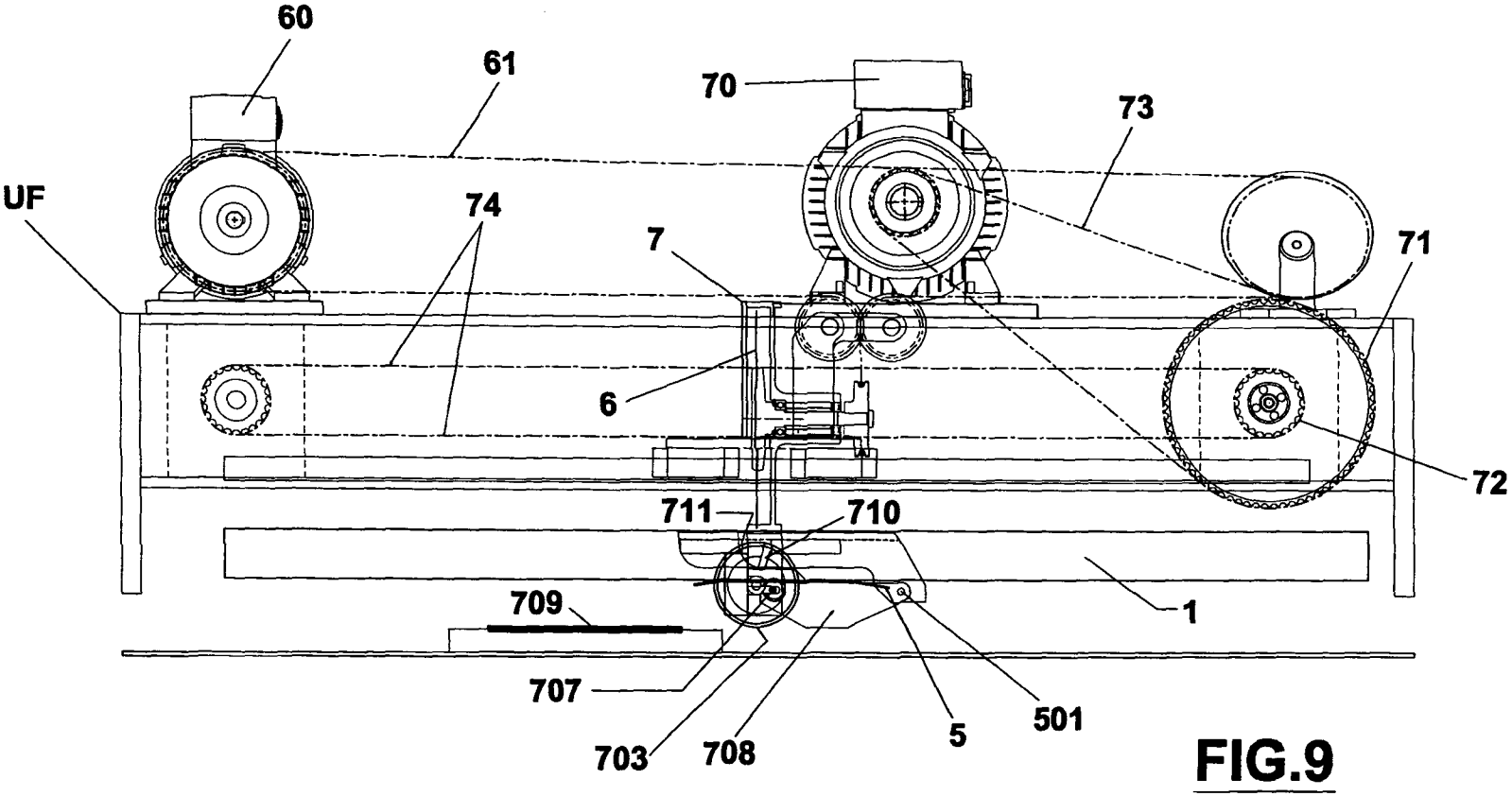
FIGS. 9-11 show another embodiment of a cutting unit according to the present invention and are a side view of the cutting unit during a tube-forming step (FIG. 9) and during a cutting step (FIG. 10), and a front view (FIG. 11) with parts transversely sectioned.
Figure 10:
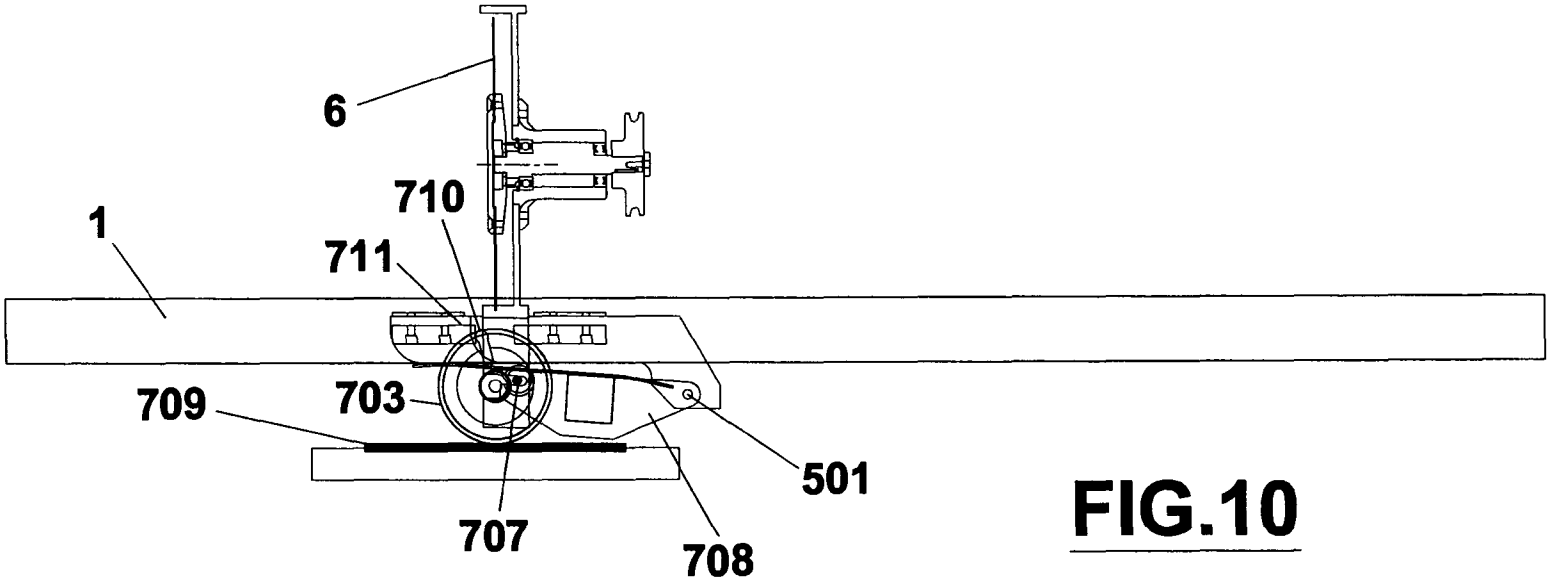
Figure 11:
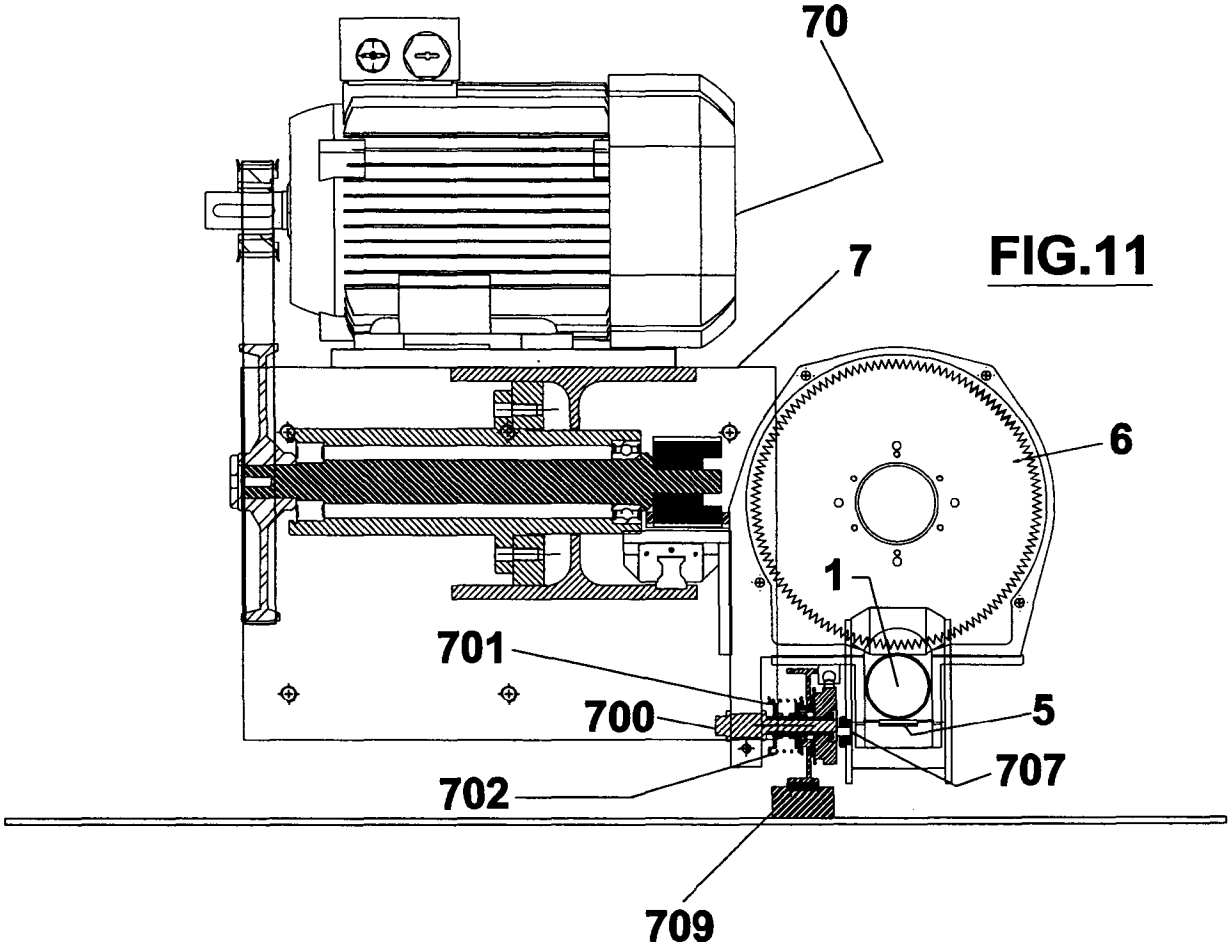
Figure 12:
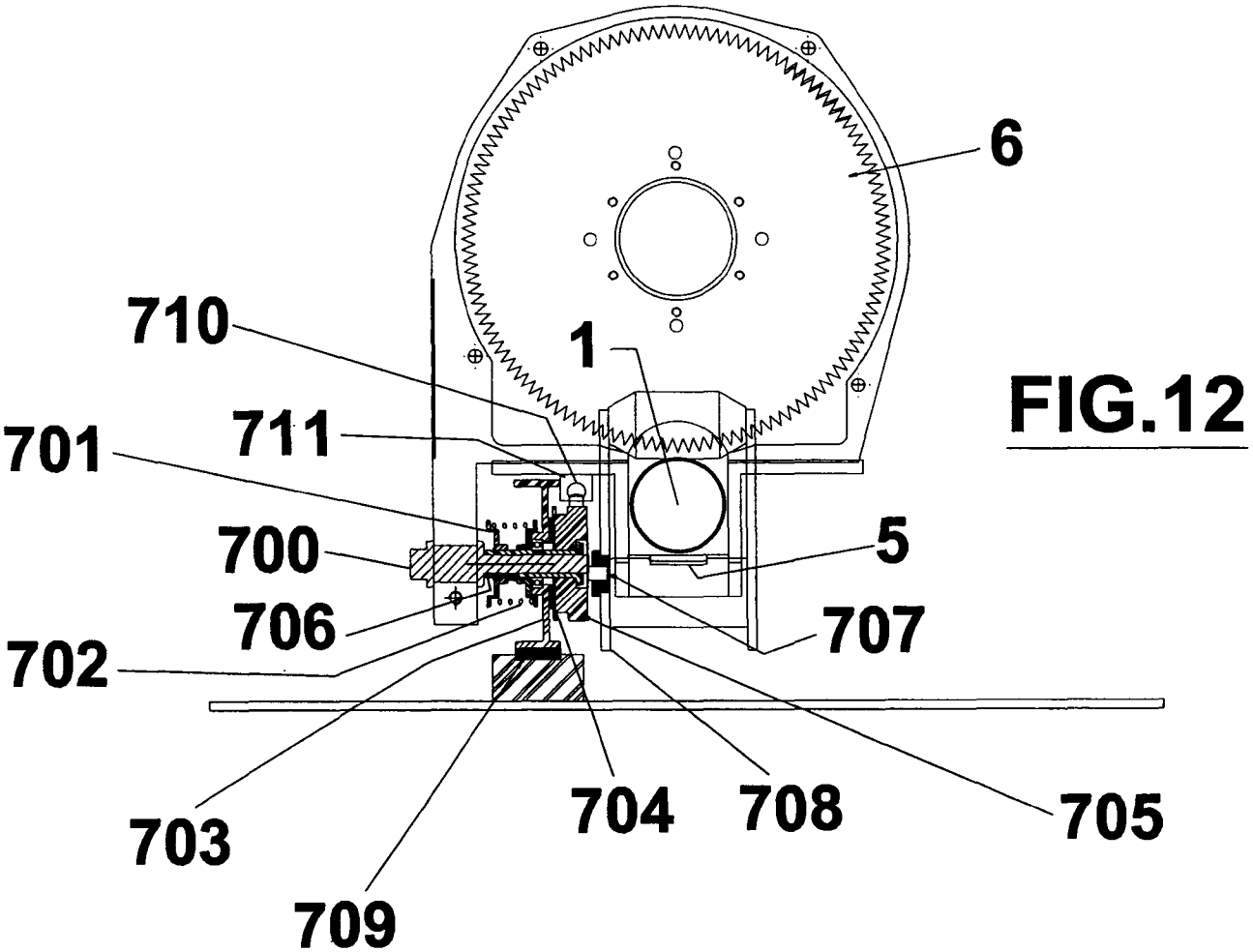
FIG. 12 is an enlarged detail of FIG. 11.

With reference to the example illustrated in FIGS. 9-11, the following elements are shown:

- the motor (60), which is placed in a fixed position on the frame (UF) of the cutting unit, and actuates the blade (6) by means of a belt (61);
- the motor (70) which drives the carriage (7) by means of a gear transmission (71, 72) and belts (73, 74);
- a mechanism for moving the second guide (5).

In particular, the said movement mechanism for the second guide (5) comprises a pin (700) protruding from a lower edge of a side of the carriage (7), on which pin (700) is fitted a coaxial bush (706) and the latter is mounted on a pressure plate (701) with the corresponding compression spring (702) coaxial and external to the pin (700) and the bushing (706). The pin (700) is oriented transversely to said side of the carriage (7), that is parallel to the axis of the motor (70) that moves the carriage (7), and has a tail or root portion inserted in said sidewall and an opposite free end facing the plane of the blade (6) so as to be oriented perpendicular to the second guide (5). On the bushing (706) there is fitted a wheel (703) which is pushed from behind by the pressure plate (701). In practice, the pressure plate (701) exerts on the wheel (703) a direct thrust towards the free end of the pin (700). The wheel (703) is arranged so as to have a first face turned towards the cup (701) and a second face turned towards the free end of the pin (700). On the second face of the wheel (703) is applied a friction disc (704). A cylindrical pad (705) is fitted near the free end of the bushing (706). The friction disc (704) is positioned between the second face of the wheel (703) and the pad (705). Furthermore, the pad (705) has a transverse eccentric pin (707) which projects axially from the face opposite to that facing the friction disc (704). The pad (705) also features a radial pin (710) intended to abut, as further described in the following, with a fixed element (711) located above the same pad (705). Said transverse eccentric pin (707) is inserted in a side (the left side 708 in FIG. 11) of the second guide (5) which consists of a box-like structure open at the top, with a right side and a left side and a lower base constituted by a movable plate (500), and wherein the two sides are connected to a lower rear appendage of the carriage (7) by means of a transverse horizontal pin (501). Therefore, the guide (5) moves with the carriage (7) parallel to the tube (1) to be cut and can rotate around the axis of the pin (501) so as to be able to lift the tube (1) towards the blade (6) as further described in the following. In a predetermined area below the path followed by the carriage (7) is placed a segment of friction material (709) on which bears the wheel (701) when the carriage (7) is in the position predetermined for the cutting of the tube (1). The contact between the segment (709) of friction material and the wheel (701), while the carriage (7) moves, causes the rotation of the latter and, consequently, determines the rotation of the pad (705) which transmits this rotation to the guide (5), via the pin (707), until the radial pin (710) abuts on the overlying fixed element (711). Therefore, when the carriage (7) moves forward, that is in the process of execution of the cut of the tube (1) by the blade (6), the guide (5) is lifted (by rotating around the axis of the pin 501) and thereby lifts the tube (1) by pushing it against the blade (6) as in FIG. 10. This position raised of the tube (1) is maintained until the completion of the cut. In this phase, the wheel (701) is free to rotate around its own axis thanks to the clutch (704) even if the further rotation of the pad (705) is prevented by the radial pin (710) in abutment on the element (711). The forward stroke of the carriage continues and, after the segment (709), the wheel (703) has no more friction on the same segment (709), so that the radial pin (710) is no longer in abutment on the element (711) and consequently the pad (705) rotates in the opposite direction to the previous one bringing the guide (5) back down (as in FIG. 9). The lowered position of the guide (5) is retained in the return stroke of the carriage.

As can be seen from the above description, in each of the examples the cutting unit is arranged to push the tube (1) to be cut towards the blade (6). In the first example described above, the movable part (5) of the element (4, 5, 8) that supports the tube (1) is mechanically independent of the carriage (7). In the other examples, the said mobile part (5) is mechanically secured to the carriage (7), in such a way that the movement of the latter involves the movement of the mobile part (5).

Preferably, the blade is vertical. Furthermore, preferably, the blade executes the cut by removing material from the tube (1). For example, the blade is serrated as shown schematically in FIG. 11.

In practice the details of execution may vary in any equivalent way as for what concerns the individual elements described and illustrated, and their arrangement, without departing from the scope of the adopted solution and thus remaining within the limits of the protection granted to the present patent.

The invention claimed is:

1. A machine for cutting cardboard tubes, the machine comprising:

a cutting unit comprising a carriage on which is mounted a blade and a support element for supporting a cardboard tube to be transversely cut by the blade, wherein said support element allows the tube to slide along a predetermined direction parallel to a longitudinal axis of the tube and to rotate about the longitudinal axis, wherein said carriage is adapted to move bidirectionally such that the blade moves parallel to the longitudinal axis of the tube, said support element having a part where said cutting unit is arranged, said part being movable from and towards the blade to maintain the tube spaced from the blade and, respectively, for approaching the tube to the blade during a cutting phase.

2. A machine according to claim 1, wherein said support element comprises a fixed part upstream of the cutting unit, a movable part in an area of intervention of the blade, and a fixed part downstream of the cutting unit.

3. A machine according to claim 1, wherein said predetermined direction is horizontal.

4. A machine according to claim 1, wherein said support element has a concave cross section, with a concavity facing upwards.

5. A machine according to claim 4, wherein said support element has a V-shaped cross section.

6. A machine according to claim 1, wherein the cutting unit is placed downstream of a tube forming machine which produces the tube, said support element extending between the tube forming machine and the cutting unit and downstream of the cutting unit ends with a conveyor that moves away cuts formed by the cutting of the tube.

7. A machine according to claim 1, wherein said part of the support element is constrained to said carriage.

8. A machine according to claim 1, wherein said part of the support is independent from said carriage.

9. A machine according to claim 1, wherein said blade is vertically oriented.

10. A machine according to claim 1, wherein said blade is adapted to remove material from the tube.

11. A machine according to claim 2, wherein said predetermined direction is horizontal.

* * * * *